US010321788B2

(12) United States Patent
Broughton

(10) Patent No.: US 10,321,788 B2
(45) Date of Patent: Jun. 18, 2019

(54) PORTABLE CONTAINER APPARATUS

(71) Applicant: Eron Broughton, Venice, CA (US)

(72) Inventor: Eron Broughton, Venice, CA (US)

( * ) Notice: Subject to any disclaimer, the term of this patent is extended or adjusted under 35 U.S.C. 154(b) by 0 days.

(21) Appl. No.: 15/659,270

(22) Filed: Jul. 25, 2017

(65) Prior Publication Data

US 2018/0192831 A1 Jul. 12, 2018

Related U.S. Application Data

(60) Provisional application No. 62/366,527, filed on Jul. 25, 2016.

(51) Int. Cl.

| | |
|---|---|
| ***A47K 3/28*** | (2006.01) |
| ***A47K 5/03*** | (2006.01) |
| *A47K 3/40* | (2006.01) |

(52) U.S. Cl.

CPC ..... *A47K 3/288* (2013.01); *A47K 3/281* (2013.01); *A47K 5/03* (2013.01); *A47K 3/40* (2013.01)

(58) Field of Classification Search

CPC ..... A47J 41/005; A47J 47/14; A47K 3/288
USPC ..... 220/532, 533, 23.88
See application file for complete search history.

(56) References Cited

U.S. PATENT DOCUMENTS 1,742,279 A * 1/1930 Reynolds ..... A45F 3/00 206/218
4,280,643 A * 7/1981 Cordova ..... A45F 3/00 206/225
4,830,190 A * 5/1989 Inagaki ..... A47J 41/005 126/261
5,007,531 A * 4/1991 Lighten ..... A47K 5/02 132/315
5,161,266 A * 11/1992 Hildebrand ..... A47K 3/288 222/475
5,678,259 A * 10/1997 Cruz, Jr. ..... A47K 3/022 15/104.92
5,774,908 A * 7/1998 Hall ..... A47K 3/325 4/602
5,911,520 A * 6/1999 Kenney ..... A47K 3/288 4/603
6,039,202 A * 3/2000 Olstad ..... A45C 11/20 220/23.88
8,181,812 B2 * 5/2012 Christenson ..... B65D 25/06 220/529
2009/0076468 A1 * 3/2009 Hoffoss ..... A47K 3/288 604/310
2013/0305449 A1 * 11/2013 Allos ..... B05B 1/24 4/616
2016/0346803 A1 * 12/2016 Crawford ..... B05B 9/04

* cited by examiner

*Primary Examiner* — Janie M Loeppke
(74) *Attorney, Agent, or Firm* — Bruce A. Lev

(57) ABSTRACT

A portable container apparatus is a portable washing and shower station having a rectangular container with removable divider inserts and removable compartment inserts inside to create various compartments for the storage of various cleaning accessories, and is formed to hold up to four removable water containers that are insulated to maintain either a warm or a cold water temperature, or a mixture for washing or showering. A foot pump is able to pressurize the water tanks to force the water through a coiled shower hose and shower head, and a removable perforated base within and above the inside bottom of the outer casing is sturdy enough to stand on while showering and draining the used water through the perforated base into the catchment below.

19 Claims, 4 Drawing Sheets

PORTABLE CONTAINER APPARATUS

CROSS-REFERENCE TO RELATED APPLICATION

The present application is related to and claims priority from prior provisional application Ser. No. 62/366,527, filed Jul. 25, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of portable showers and more specifically relates to a portable container apparatus.

2. Description of the Related Art

Family trips to the beach or to the lake are memorable times for families. Fishing and swimming are popular pastimes for many people on these outings. When it comes time to head back to the vehicle and go home, sometimes it creates some unpleasant memories as well. People, especially children, tend to bring back sand, dirt, or mud clinging to the legs, clothes, or feet, and people that are particular about keeping a clean vehicle can tend to get edgy when it is drug into the vehicle requiring a big cleanup later. Cleaning fish tends to bring a different unwanted constituent back to the vehicle which can adhere to inside vehicle surfaces as well, and have the added unpleasantness of bad odor. Melted ice in the drink cooler provides some water for washing but generally has such a low temperature that only very small amounts of water, not enough to get clean, gets used. At times, more than a wash-up is needed. Children tend to get sand in their hair which ends up all over the inside of the vehicle on the trip home. In reality, they actually need a shower before getting back into the vehicle. When camping in remote areas for any duration of time, adults as well need to shower, and a wet washcloth doesn't always make the individual feel much cleaner. Makeshift showers are usually constructed of various materials and work for one-time use but lack very much in convenience. The bathing materials such as soap, washcloths, shampoo, must be set in a convenient location while bathing. The amount of materials taken to accommodate such a trip tends to fill a vehicle and must be searched for in the camping gear or the vehicle in order to construct the shower. A more convenient solution to these problems is needed.

Various attempts have been made to solve the above-mentioned problems such as those found in U.S. Pat. No. 9,179,806 to Kristian Allos; U.S. Pat. No. 5,774,908 to Charles P. Hall; and U.S. Pat. No. 4,280,643 to Sam Cordova et al. This art is representative of portable showers. None of the above inventions and patents, taken either singly or in combination, is seen to describe the invention as claimed.

Ideally, a portable shower should provide a multipurpose container that is completely self contained, and, yet would operate reliably and be manufactured at a modest expense. Thus, a need exists for a reliable portable container apparatus to avoid the above-mentioned problems.

BRIEF SUMMARY OF THE INVENTION

In view of the foregoing disadvantages inherent in the known portable shower art, the present invention provides a novel portable container apparatus. The general purpose of the present invention, which will be described subsequently in greater detail, is to provide a multipurpose container that is completely self-contained.

The portable container apparatus may comprise a main body that includes a first side having a plurality of spaced divider insert holder members, a second side having a plurality of spaced connector portions, a third side including a plurality of spaced divider insert holder members, a fourth side including a plurality of spaced connector portions, a base member including a plurality of drainage perforations therethrough adapted to allow water to pass therethrough and is connected to lower edge portions of the first, second, third, and fourth sides forming a rectangular interior volume and a plurality of divider inserts.

The plurality of divider inserts are adapted to be respectively placed within and between respective opposing divider insert holder members of the first and third sides thereby forming a plurality of individual compartments. A lid member is adapted to be removably attached to an upper edge of at least one of the first, second, third, and fourth sides. At least one removable water tank is adapted to be releasably connected to one of the spaced connector portions upon the second and fourth sides and reside within the rectangular interior volume and is adapted to hold water therein and dispense the water.

At least one removable capsule is adapted to be releasably connected to one of the plurality of spaced connector portions upon the second and fourth sides and reside within the rectangular interior volume, and is adapted to hold beach gear therein. The base member further includes a textured slip resistant material on the upper surface. The second side includes a drainage nozzle attached thereto in proximity to the lower edge portion and is adapted to allow water to controllably drain outwardly from the rectangular interior volume. The lid member further includes a plurality of drainage perforations adapted to allow water to pass therethrough and the lid member further includes a textured slip resistant material on an upper surface thereof.

The divider inserts are preferably formed having a rectangular shape. The at least one removable water tank is adapted to hold at least 2½ gallons of water therein. The removable water tank is formed from an insulating material adapted to retain the temperature of the water and includes a removable cap member thereon. The removable cap member is removably attached via respective interdigitating thread members. There are three divider insert holder members on both the first and third sides, and there are three the divider inserts respectively and removably placed within and between respective opposing divider insert holder members thereby forming four individual compartments.

There are two spaced connector portions on each of the second and fourth sides and there are four water tanks releasably and respectively connected to the four spaced connector portions. The removable capsule(s) include(s) at least one pocket member therein adapted to store items therein. A removable shower head including a shower head hose member is adapted to be releasably connected to at least one of the removable water tanks, to thereby allow the user to transfer water from within each of the removable water tank(s) and upon themselves.

The invention may be offered as a portable beach shower kit comprising a water dispenser member including a water holding tank portion and a hose member connected to the water holding tank portion that is adapted to transfer water therefrom. The water dispenser member is adapted to hold water therein for use within the portable container apparatus. The hand pump member is adapted to be connected to the water holding tank portion and pump water from the water holding tank portion through the hose member. The portable container apparatus may comprise a main body having a first side including a plurality of spaced divider insert holder members, a second side including a plurality of spaced connector portions, a third side including a plurality of spaced divider insert holder members, a fourth side including a plurality of spaced connector portions, and a base member including a plurality of drainage perforations therethrough adapted to allow water to pass therethrough.

The base member is connected to the lower edge portions of the first, second, third, and fourth sides forming a rectangular interior volume. The plurality of divider inserts are adapted to be respectively placed within and between respective opposing divider insert holder members of the first and third sides, thereby forming a plurality of individual compartments. The lid member is adapted to be removably attached to the upper edge of at least one of the sides.

At least one removable water tank is adapted to be releasably connected to one of the spaced connector portions upon the second and fourth sides and reside within the rectangular interior volume, and is adapted to hold water therein and dispense the water. At least one removable capsule is adapted to be releasably connected to one of the plurality of spaced connector portions upon the second and fourth sides and reside within the rectangular interior volume to hold beach gear therein.

The portable container apparatus further comprises a removable shower head including a shower head hose member adapted to be releasably connected to at least one removable water tank to thereby allow a user to transfer water from within each of the removable water tanks and upon themselves. The second side of the portable container apparatus further includes a drainage nozzle attached thereto in proximity to the lower edge portion thereof and is adapted to allow water to controllably drain outwardly from the rectangular interior volume.

The portable container apparatus comprises three divider insert holder members on both the first and third sides, and there are three divider inserts respectively and removably placed within and between respective opposing divider insert holder members thereby forming afour individual compartments. There are four water tanks releasably and respectively connected to the four spaced connector portions. The removable capsule(s) include at least one pocket member therein adapted to store items therein.

The present invention holds significant improvements and serves as a portable container apparatus. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, portable container apparatus constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a portable shower and more particularly to a portable container apparatus as used to improve the portability and convenience of a completely self contained shower apparatus.

Generally speaking, portable container apparatus is a portable washing and shower station having a rectangular container with removable divider inserts and removable compartment inserts inside to create various compartments for the storage of various cleaning accessories, and is formed to hold up to four removable water containers that are insulated to maintain either a warm or a cold water temperature, or a mixture for washing or showering. A hand pump is able to pressurize the water tanks to force the water through a coiled shower hose and shower head, and a removable perforated base within and above the inside bottom of the outer casing is sturdy enough to stand on while showering and draining the used water through the perforated base into the catchment below.

Figure 1:
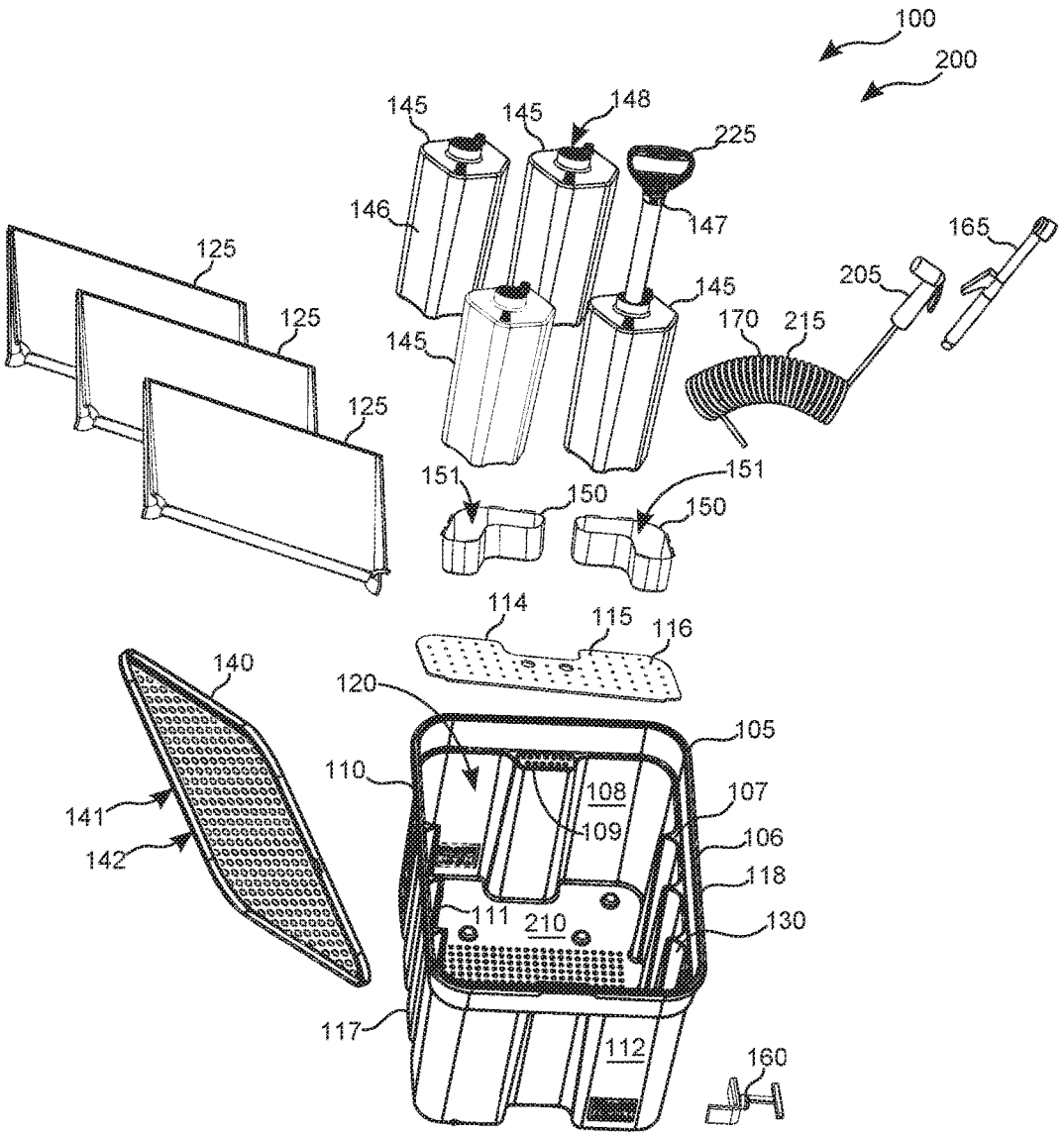
FIG. 1 shows a perspective view illustrating a portable beach shower kit 200 of a portable container apparatus in an unassembled condition according to an embodiment of the present invention.

Referring to the drawings by numerals of reference there is shown in FIG. 1, shows a perspective view illustrating a portable beach shower kit 200 of a portable container apparatus 100 in an unassembled condition according to an embodiment of the present invention.

Portable container apparatus 100 may comprise main body 105 that includes first side 106 having a plurality of spaced divider insert holder members 107, second side 108 having a plurality of spaced connector portions 109, third side 110 including a plurality of spaced divider insert holder members 111, fourth side 112 including a plurality of spaced connector portions 109, base member 114 including a plurality of drainage perforations 115 adapted to allow water to pass therethrough and is connected to lower edge portions 117 of the first 106, second 108, third 110, and fourth 112 sides forming rectangular interior volume 120 and a plurality of divider inserts 125. As such a user may create customized individual compartments 135 within portable container apparatus 100 for storing objects. This functionality may be useful for dividing wet gear from dry gear and dirty gear from clean gear.

The plurality of divider inserts 125 are adapted to be respectively placed within and between respective opposing spaced divider insert holder members 130 and spaced divider insert holder members 111 of the first 106 and third sides 110 thereby forming a plurality of Individual compartments 135. Portable container apparatus 100 may be manufactured of lightweight sturdy materials such that it may be easier to transport and may not easily break. Lid member 140 is adapted to be removably attached to upper edge 118 of at least one of first side 106, second side 108, third side 110, and fourth side 112. At least one removable water tank 145 is adapted to be releasably connected to one of spaced connector portions 109 upon second side 108 and fourth sides 112 and reside within rectangular interior volume 120 and is adapted to hold water therein and dispense the water. The at least one removable water tank 145 may comprise a threaded lid member 140 similar to a bottle cap useful for filling up or removing water from removable water tank 145. The at least one removable water tank 145 may comprise insulation useful for maintaining a hot temperature of water placed there within.

Figure 2:
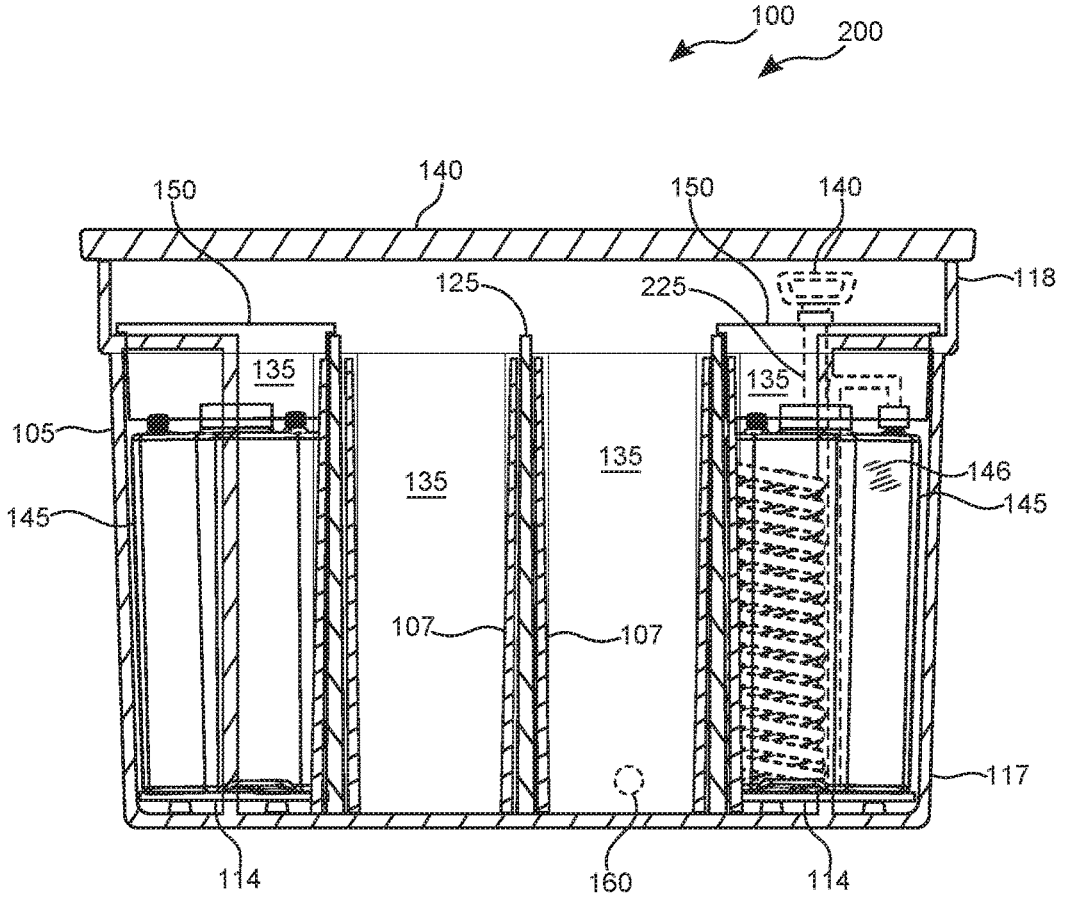
FIG. 2 is a side cutaway view illustrating the portable container apparatus according to an embodiment of the present invention of FIG. 1.

Referring now to FIG. 2, is a side cutaway view illustrating portable container apparatus 100 according to an embodiment of the present invention of FIG. 1.

At least one removable capsule 150 is adapted to be releasably connected to one of the plurality of spaced connector portions 109 upon second side 108 and fourth side 112 and reside within rectangular interior volume 120, and is adapted to hold beach gear therein. Base member 114 further includes textured slip resistant material 175 on upper surface 116, useful for preventing a user from slipping when standing in portable container apparatus 100 and taking a shower or washing off. Textured slip resistant material 175 on upper surface 116 is also useful for preventing a user from slipping when standing on lid member 140 when it is removed from portable container apparatus 100 and placed on a ground surface. As such, lid member 140 may be used as a second wash station for a user. Second side 108 includes drainage nozzle 160 attached thereto in proximity to lower edge portions 117 and is adapted to allow water to controllably drain outwardly from rectangular interior volume 120. Drainage nozzle 160 may be useful for draining dirty water from rectangular interior volume 120 of portable container apparatus 100. Lid member 140 further includes a plurality of drainage perforations 115 adapted to allow water to pass therethrough and lid member 140 further includes textured slip resistant material 175 on upper surface 142 thereof.

Divider inserts 125 are preferably formed having a rectangular shape. The at least one removable water tank 145 is adapted to hold at least 2½ gallons of water therein. Removable water tank 145 is formed from insulating material 146 adapted to retain the temperature of the water and includes removable cap member 147 thereon. Removable cap member 147 is removably attached via respective interdigitating thread members 148. There are three divider insert holder members 130 on both first side 106 and third side 110, and there are three divider inserts 125 respectively and removably placed within and between respective opposing divider insert holder members 130 thereby forming four individual compartments 135.

Figure 3:
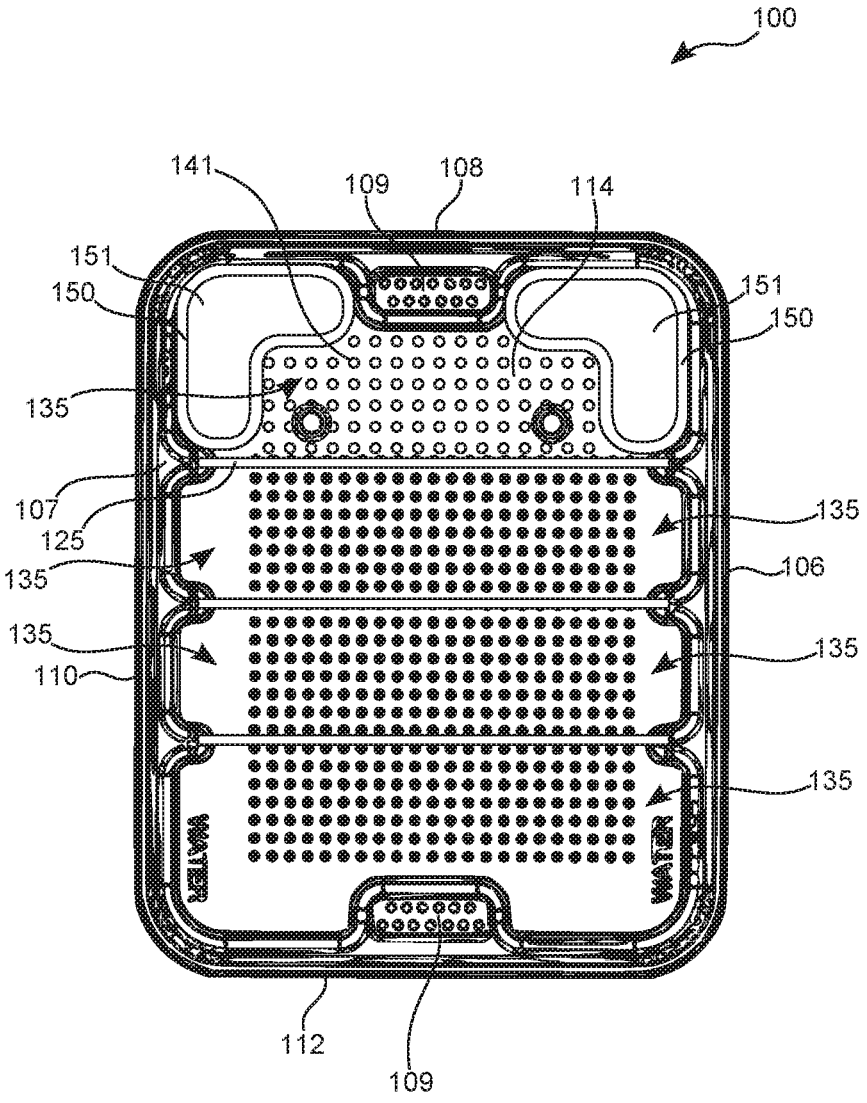
FIG. 3 is a top plan view illustrating the main body of the portable container apparatus according to an embodiment of the present invention of FIG. 1.

Referring now to FIG. 3, is a top plan view illustrating main body 105 of portable container apparatus 100 according to an embodiment of the present invention of FIG. 1.

There are two spaced connector portions 109 on each of second side 108 and fourth sides 112 and there are four removable water tank 145 releasably and respectively connected to the four spaced connector portions 109. Removable capsules 150 include(s) at least one pocket member 151 therein adapted to store items therein. Removable shower head 165 including shower head hose member 170 is adapted to be releasably connected to at least one of removable water tank 145, to thereby allow the user to transfer water from within each of removable water tanks 145 and upon themselves.

The invention may be offered as portable beach shower kit 200 comprising water dispenser member 205 including water holding tank portion 210 and hose member 215 connected to water holding tank portion 210 that is adapted to transfer water therefrom. Water dispenser member 205 is adapted to hold water therein for use within portable container apparatus 100. Hand pump member 225 is adapted to be connected to water holding tank portion 210 and pump water from water holding tank portion 220 through hose member 215. Portable container apparatus 100 may comprise main body 105 having first side 106 including a plurality of spaced divider insert holder members 107, second side 108 including a plurality of spaced connector portions 109, third side 110 including a plurality of spaced divider insert holder members 111, fourth side 112 including a plurality of spaced connector portions 109, and base member 114 including a plurality of drainage perforations 141 therethrough adapted to allow water to pass therethrough.

Figure 4:
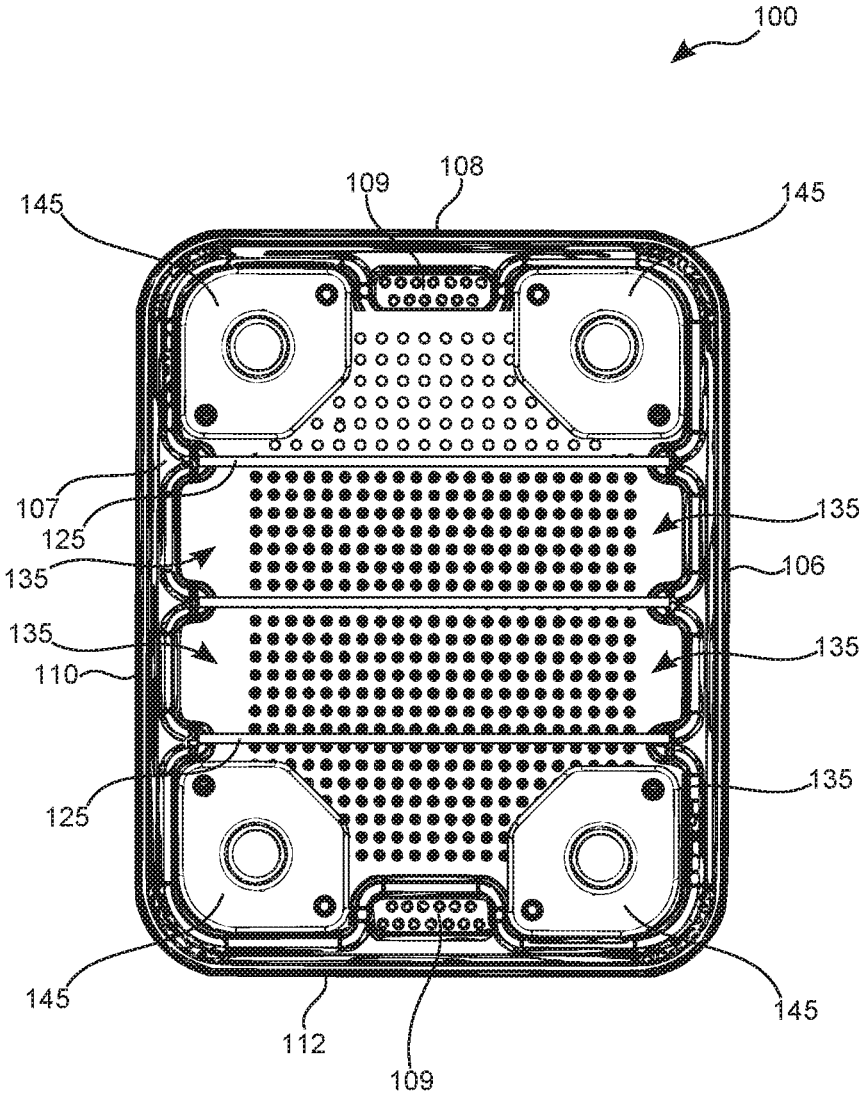
FIG. 4 is a top plan view illustrating the location of the removable water tanks within the portable container apparatus according to an embodiment of the present invention of FIG. 1.

Referring now to FIG. 4, is a top plan view illustrating the location of removable water tanks 145 within portable container apparatus 100 according to an embodiment of the present invention of FIG. 1.

Base member 114 is connected to lower edge portions 117 of first side 106, second side 108, third side 110, and fourth side 112 forming rectangular interior volume 120. The plurality of divider inserts 125 are adapted to be respectively placed within and between respective opposing divider insert holder members 130 of first side 106 and third side 110, thereby forming a plurality of individual compartments 135. Lid member 140 is adapted to be removably attached to upper edge 118 of at least one of first side 106, second side 108, third side 110, or fourth side 112. Lid member 140 of portable container apparatus 100 may snap fit to upper edge 118 of portable container apparatus 100 in order to be secure for holding objects. Alternatively, other securing means may be used to secure lid member 140 of portable container apparatus 100.

At least one removable water tank 145 is adapted to be releasably connected to one of spaced connector portions 109 upon second side 108 and fourth side 112 and reside within rectangular interior volume 120, and is adapted to hold water therein and dispense the water. At least one removable capsule 150 is adapted to be releasably connected to one of the plurality of spaced connector portions 109 upon second side 108 and fourth side 112 and reside within rectangular interior volume 120 to hold beach gear therein.

Portable container apparatus 100 further comprises removable shower head 165 including shower head hose member 170 adapted to be releasably connected to at least one removable water tank 145 to thereby allow a user to transfer water from within each of removable water tanks 145 and upon themselves. Second side 108 of portable container apparatus 100 further includes drainage nozzle 160 attached thereto in proximity to lower edge portions 117 thereof and is adapted to allow water to controllably drain outwardly from rectangular interior volume 120.

Portable container apparatus 100 comprises three divider insert holder members 130 on both first side 106 and third side 110, and there are three divider inserts 125 respectively and removably placed within and between respective opposing divider insert holder members 130 thereby forming four individual compartments 135. There are four removable water tanks 145 releasably and respectively connected to the four spaced connector portions 109. Removable capsule(s) 150 include at least one pocket member 151 therein adapted to store items therein.

Portable container apparatus 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Upon reading this specification, it should be appreciated that, under appropriate circumstances, considering such issues as design preference, user preferences, marketing preferences, cost, structural requirements, available materials, technological advances, etc., other methods and purposes of use may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A portable container apparatus comprising:

a main body including:

a first side including:

a plurality of spaced divider insert holder members;

a second side including:

a plurality of spaced connector portions;

a third side including:

a plurality of spaced divider insert holder members;

a fourth side including:

a plurality of spaced connector portions;

a base member including:

a plurality of drainage perforations therethrough adapted to allow water to pass therethrough;

wherein said base member is connected to lower edge portions of said first, second, third, and fourth sides; and wherein said base member and said first, second, third, and fourth sides form a rectangular interior volume; and a plurality of divider inserts;

wherein said a plurality of divider inserts are adapted to be respectively placed within and between respective opposing said plurality of divider insert holder members of said first and third sides, thereby forming a plurality of individual compartments;

a lid member;

wherein said lid member is adapted to be removably attached to an upper edge of at least one of said first, second, third, and fourth sides;

at least one removable water tank;

wherein said at least one removable water tank is adapted to be releasably connected to one of said plurality of spaced connector portions upon said second and fourth sides and reside within said rectangular interior volume, and is adapted to hold water therein and dispense said water; and at least one removable capsule;

wherein said at least one removable capsule is adapted to be releasably connected to one of said plurality of spaced connector portions upon said second and fourth sides and reside within said rectangular interior volume; and wherein said second side further includes a drainage nozzle attached thereto in proximity to said lower edge portion thereof and is adapted to allow water to controllably drain outwardly from said rectangular interior volume.

2. The portable container apparatus of claim 1, wherein said base member further includes a textured slip resistant material on an upper surface thereof.

3. The portable container apparatus of claim 1, wherein said lid member further includes a textured slip resistant material on an upper surface thereof.

4. The portable container apparatus of claim 1, wherein said plurality of divider inserts are formed having a rectangular shape.

5. The portable container apparatus of claim 1, wherein said at least one removable water tank is adapted to hold at least 2½ gallons of water therein.

6. The portable container apparatus of claim 1, wherein said at least one removable water tank is formed from an insulating material adapted to retain the temperature of the water therein.

7. The portable container apparatus of claim 1, wherein said at least one removable water tank includes a removable cap member thereon; wherein said removable cap member is removably attached via respective interdigitating thread members.

8. The portable container apparatus of claim 1, wherein there are three said divider insert holder members on both said first and third sides; and wherein there are three said divider inserts respectively and removably placed within and between respective opposing said three divider insert holder members, thereby forming four individual compartments.

9. The portable container apparatus of claim 8, wherein there are two spaced connector portions on each of said second and fourth sides.

10. The portable container apparatus of claim 9, wherein there are four water tanks releasably and respectively connected to said four spaced connector portions.

11. The portable container apparatus of claim 1, wherein said at least one removable capsule includes at least one pocket member therein adapted to store items therein.

12. The portable container apparatus of claim 1, further comprising a removable shower head including a shower head hose member adapted to be releasably connected to one of said at least one removable water tank, to thereby allow a user to transfer water from within each of said at least one removable water tank and upon themselves.

13. A portable beach shower kit comprising:

a water dispenser member including:

a water holding tank portion; and a hose member connected to said water holding tank portion and adapted to transfer water therefrom;

wherein said water dispenser member is adapted to hold water therein for use within a portable container apparatus;

a foot pump member;

wherein said foot pump member is adapted to be connected to said water holding tank portion and pump water from said water holding tank portion and through said hose member; and a portable container apparatus comprising:

a main body including:

a first side including:

a plurality of spaced divider insert holder members;

a second side including:

a plurality of spaced connector portions;

a third side including:

a plurality of spaced divider insert holder members;

a fourth side including:

a plurality of spaced connector portions;

a base member including:

a plurality of drainage perforations therethrough adapted to allow water to pass therethrough;

wherein said base member is connected to lower edge portions of said first, second, third, and fourth sides; and wherein said base member and said first, second, third, and fourth sides form a rectangular interior volume; and a plurality of divider inserts;

wherein said a plurality of divider inserts are adapted to be respectively placed within and between respective opposing said plurality of divider insert holder members of said first and third sides, thereby forming a plurality of individual compartments;

a lid member;

wherein said lid member is adapted to be removably attached to an upper edge of at least one of said first, second, third, and fourth sides;

at least one removable water tank;

wherein said at least one removable water tank is adapted to be releasably connected to one of said plurality of spaced connector portions upon said second and fourth sides and reside within said rectangular interior volume, and is adapted to hold water therein and dispense said water; and at least one removable capsule;

wherein said at least one removable capsule is adapted to be releasably connected to one of said plurality of spaced connector portions upon said second and fourth sides and reside within said rectangular interior volume.

14. The portable beach shower kit of claim 13, wherein said portable container apparatus further comprises a removable shower head including a shower head hose member adapted to be releasably connected to one of said at least one removable water tank, to thereby allow a user to transfer water from within each of said at least one removable water tank and upon themselves.

15. The portable beach shower kit of claim 14, wherein said second side of said portable container apparatus further includes a drainage nozzle attached thereto in proximity to said lower edge portion thereof and is adapted to allow water to controllably drain outwardly from said rectangular interior volume.

16. The portable beach shower kit of claim 13, wherein said portable container apparatus comprises three said divider insert holder members on both said first and third sides; and wherein there are three said divider inserts respectively and removably placed within and between respective opposing said three divider insert holder members, thereby forming four individual compartments.

17. The portable beach shower kit of claim 16, wherein there are four water tanks releasably and respectively connected to said four spaced connector portions.

18. The portable beach shower kit of claim 13, wherein said at least one removable capsule includes at least one pocket member therein adapted to store items therein.

19. A portable container apparatus comprising:

main body including:

a first side including:

a plurality of spaced divider insert holder members;

a second side including:

a plurality of spaced connector portions;

a third side including:

a plurality of spaced divider insert holder members;

a fourth side including:

a plurality of spaced connector portions;

a base member including:

a plurality of drainage perforations therethrough adapted to allow water to pass therethrough;

wherein said base member is connected to lower edge portions of said first, second, third, and fourth sides; and wherein said base member and said first, second, third, and fourth sides form a rectangular interior volume; and a plurality of divider inserts;

wherein said a plurality of divider inserts are adapted to be respectively placed within and between respective opposing said plurality of divider insert holder members of said first and third sides, thereby forming a plurality of individual compartments;

a lid member;

wherein said lid member is adapted to be removably attached to an upper edge of at least one of said first, second, third, and fourth sides;

at least one removable water tank;

wherein said at least one removable water tank is adapted to be releasably connected to one of said plurality of spaced connector portions upon said second and fourth sides and reside within said rectangular interior volume, and is adapted to hold water therein and dispense said water; and at least one removable capsule;

wherein said at least one removable capsule is adapted to be releasably connected to one of said plurality of spaced connector portions upon said second and fourth sides and reside within said rectangular interior volume; and wherein said lid member further includes a plurality of drainage perforations therethrough adapted to allow water to pass therethrough.

* * * * *